US005083616A

United States Patent [19]

Polan

[11] Patent Number: 5,083,616

[45] Date of Patent: Jan. 28, 1992

[54] CEILING SPRINKLER

[75] Inventor: George S. Polan, Harleysville, Pa.

[73] Assignee: Central Sprinkler Corporation, Lansdale, Pa.

[21] Appl. No.: 535,927

[22] Filed: Jun. 11, 1990

Related U.S. Application Data

[63] Continuation-in-part of Ser. No. 356,740, May 25, 1989, Pat. No. 4,976,320.

[51] Int. Cl.[5] ..... A62C 37/08

[52] U.S. Cl. ..... 169/40; 169/37; 169/38

[58] Field of Search ..... 169/40, 37, 38, 39, 169/42, 90

[56] References Cited

U.S. PATENT DOCUMENTS

| | | | |
|---|---|---|---|
| 506,704 | 10/1893 | Lynde | 169/40 |
| 506,929 | 10/1893 | Newton | 169/39 |
| 1,608,515 | 11/1926 | Lowe | 169/40 |
| 1,816,016 | 7/1931 | Knight | 169/40 |
| 2,125,510 | 8/1938 | Lewis | 169/38 |
| 2,558,450 | 6/1953 | Martin | 169/37 |
| 3,195,647 | 7/1965 | Campbell et al. | 169/40 |
| 3,633,676 | 1/1972 | Gloeckler | 169/40 |
| 3,756,321 | 9/1973 | Gloeckler | 169/40 |
| 3,831,682 | 8/1974 | Calcaro | 169/37 |
| 3,863,720 | 2/1975 | Young | 169/40 |
| 4,014,388 | 3/1977 | Anderson | 169/37 |
| 4,015,665 | 4/1977 | Simons et al. | 169/40 |
| 4,105,076 | 8/1978 | Simons et al. | 169/40 |
| 4,176,719 | 12/1979 | Bray | 169/39 |
| 4,217,960 | 8/1980 | Miyazaki | 169/38 |
| 4,405,018 | 9/1983 | Fischer | 169/37 |
| 4,596,289 | 6/1986 | Johnson | 169/37 |
| 4,618,002 | 10/1986 | Mears | 169/37 |
| 4,766,961 | 8/1988 | Macie | 169/37 |
| 4,785,888 | 11/1988 | Blum et al. | 169/39 |
| 4,880,063 | 11/1989 | Leininger et al. | 169/37 |
| 4,930,578 | 6/1990 | Barnett et al. | 169/39 |

FOREIGN PATENT DOCUMENTS

| | | | |
|---|---|---|---|
| 1065276 | 9/1959 | Fed. Rep. of Germany . | |
| 346984 | 4/1931 | United Kingdom | 169/39 |
| 885421 | 12/1961 | United Kingdom | 169/40 |
| 954967 | 4/1964 | United Kingdom . | |
| 1359857 | 7/1974 | United Kingdom | 169/37 |

*Primary Examiner*—Joseph F. Peters, Jr.
*Assistant Examiner*—Christopher P. Ellis
*Attorney, Agent, or Firm*—Panitch Schwarze Jacobs & Nadel

[57] ABSTRACT

A fork type ceiling sprinkler includes a sprinkler body and a fork coupled to an outlet end of the sprinkler body. The fork has a pair of arms extending away from an outlet end of the body. Free end portions of the arms define a gap aligned with an outlet of the sprinkler body. A plug is releasably retained in the outlet by a pair of levers extending from the plug to sloping surfaces provided by bosses on the inner sides of the two fork arms. A temperature-sensitive element between the levers prevents the levers from sliding off sloping arms until the sprinkler is activated. A stamped deflector plate is supported on pins slidably mounted through the fork arms. A cup is adjustably mounted through bracket arms to the sprinkler on the outside of the fork arms that support the deflector.

20 Claims, 2 Drawing Sheets

CEILING SPRINKLER

This application is a continuation-in-part of U.S. Pat. application Ser. No. 07/356,740 filed May 25, 1989, now U.S. Pat. No. 4,976,320 incorporated by reference herein.

BACKGROUND OF THE INVENTION

The above-identified related patent application discloses a fork-type ceiling sprinkler which includes a pair of arms extending away from the sprinkler body on an outlet side of the body. The fork-type sprinkler disclosed differs from a conventional frame-type sprinklers in that the arms of the fork do not come together directly or with a cross member opposite the outlet. The only function of the arms disclosed in the related application is to support a drop-down deflector aligned with the outlet. As a result of this design, water or other fire-retarding fluid delivered by the sprinkler flows unrestrictedly and uninterruptedly from the outlet directly onto the deflector, eliminating a frame shadow in the dispersion of the fluid. A plug is sealingly retained in the outlet by means of a lever assembly which couples to the sprinkler body itself. Thus, no significant system loads are imposed upon the arms except to support the deflector after sprinkler activation. This design permits the use of forks and deflectors which are less expensive to fabricate than frames and frame supported deflectors. Either or both pieces can be provided by stamping, rather than a more costly casting or machining process typically used for the latter.

While the original design disclosed in the related, above-identified application offers the combined advantages of low fork/deflector cost and good fluid distribution without frame shadow, the latter can constitute an advantage in and of itself. Moreover, the lever assembly disclosed in the related patent application is relatively complex, incorporating two major lever elements, each with a number of cutouts, tabs and bores and an adjustment screw to adjust the pressure provided by the levers against the plug.

The present invention is directed to solving the problem of simplifying the lever construction of my earlier invention, while retaining the benefit of a shadow free fluid distribution pattern provided by a fork-type deflector mounting.

SUMMARY OF THE INVENTION

The invention is a ceiling sprinkler comprising a sprinkler body having an internal passage terminating in an outlet for discharging a pressurized, fire-retarding fluid, a plug in the outlet for sealing the passage, a pair of opposed arms, each arm having an end depending from the body and an opposing free end portion, the free ends portions of the arms being separated by a gap aligned generally with the outlet for unrestrictedly passing fluid from the outlet between the arms. The sprinkler further comprises a deflector supported from the arms aligned generally with the outlet and the gap. The invention further comprises a pair of levers, each lever extending away from the sprinkler body to an inner side of a separate one of the frame arms. Ends of the levers proximal the body retain the plug in the outlet. The sprinkler further comprises a temperature-sensitive element positioned between the levers for maintaining the separation between the lever before the sprinkler is activated. The sprinkler further comprises means on the inner side of the frame arms for biasing the levers together and for preventing movement of the levers away from the plug.

BRIEF DESCRIPTION OF THE DRAWINGS

The foregoing summary, as well as the following detailed description of the preferred embodiment of the invention, will be better understood when read in conjunction with the appended drawings. For the purpose of illustrating the invention, there is shown in the drawings, embodiments which are presently preferred. It should be understood, however, that the invention is not limited to the precise arrangements and instrumentalities shown. In the drawings.

DETAILED DESCRIPTION OF THE PREFERRED EMBODIMENT

In the various figures, like numerals are used to identify identical elements. There is shown in each of the figures, a covered ceiling sprinkler according to the present invention, indicated generally at 10, comprising a sprinkler, indicated generally at 12, and a cover, indicated generally at 14. The sprinkler 12 includes a body, indicated generally at 16, of generally tubular form.

Figure 2:
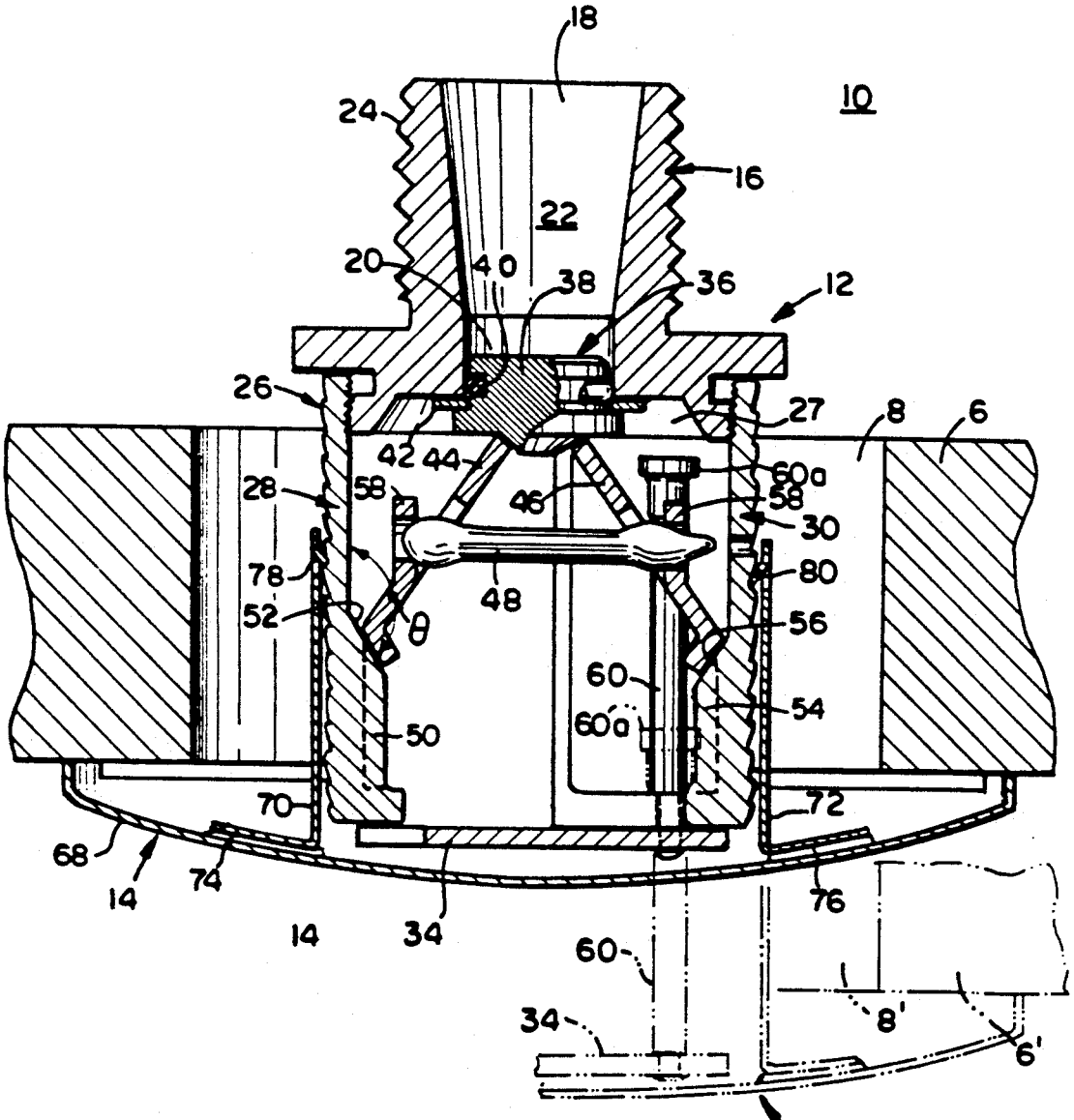
FIG. 2 is a cross-sectional elevation of the sprinkler of FIG. 1 taken along the lines 2—2 of FIG. 1.

Referring to FIG. 2, the body 16 has an inlet 18 at an upper end, an outlet 20 at a lower opposing end and an internal passage 22 connecting the inlet and the outlet. Threading 24 is provided on the outside of the body adjoining the inlet 18 for threading the inlet end of the sprinkler into a drop nipple or other conduit supplying a pressurized fire-retarding fluid. Fire-retarding fluid fed to the inlet 18 is discharged through the outlet 20 when the sprinkler 12 is activated. The sprinkler 12 further comprises a fork indicated generally at 26 having a pair of opposed arms 28 and 30. Each arm has an end which is coupled with a collar portion 27 of the fork 26 and depends from the body 16 of the sprinkler. Each arm further includes an opposing portion free end remote from the body 16. The free end portions of the arms 28 and 30 are separated by a gap indicated generally at 32, which is aligned generally with the outlet 20 for unrestrictedly passing fluid from the outlet 20 between the arms 28 and 30. A deflector plate 34 is supported from the arms 28 and 30 aligned generally with the outlet 20 and gap 32. A plug indicated generally at 36 is positioned in the outlet 20 for sealing the passage 22. The plug includes a plug body 38 having a circumferential groove receiving an 0-ring 40. A wave spring (Belleville washer) 42 is further interposed between the plug 36 and the sprinkler body 16.

A triggering mechanism is provided by a pair of levers 44 and 46 and a temperature-sensitive element 48 positioned between the levers 44, 46. Each of the levers 44, 46 extends away from the sprinkler body 16, and, preferably, directly away from the plug 36, to an inner side of a separate one of the fork arms, lever 44 to fork arm 28 and lever 46 to fork arm 30. Ends of the levers 44 and 46 proximal the body retain the plug 36 in the outlet 20. Preferably, this is accomplished by contacting the plug 36 directly with ends of each of the levers 44 and 46. although it is possible to interpose some element or elements between the levers 44 and 46 of the plug 36, if desired. According to the invention, means are provided on the inner sides of the fork arms 28 and 30 for biasing the levers 44 and 46 together and for preventing movement of the levers 44 and 46 away from the plug 36. In the preferred embodiments, the means for biasing and preventing movement constitute bosses 50 and 54 integrally formed on inner sides of the fork arms 28 and 30, respectively. An upper end of each boss 50 and 54 defines a sloping surface 52 and 56, respectively, contacted by separate ones of the levers 44 and 46, respectively. Each of the surfaces 52 and 56 extends along an inner side of a respective fork arm 28 and 30 and slopes inwardly towards the gap 32 at an included angle $\theta$ greater than about 135° and less than 180° with respect to the vertical. When the temperature-sensitive element 48 looses structural integrity, the levers 44 and 46 will be forced by the plug 36 to slip down the surfaces 52 and 56 and away from the plug 36 and outlet 20 to permit the plug 36 to be released from the outlet 20.

The temperature-sensitive element 48 may be a conventional glass ampule filled with an alcohol-based liquid or other liquid which fractures when heated to a predetermined temperature, preferably between about 155° F. and 200° F. The levers 44 and 46 are substantially identical. Each is formed from an originally planar element. An end of each lever 44 and 46 contacting the plug 36 is substantially squared off while an opposing end of each lever contacting the sloping surfaces 52 and 56 are turned to form a curving surface for contacting a sloping surface. A center portion of each lever 44 and 46 is cut and turned transversely from the general plane of the lever and bored to form temperature-sensitive element receiving member 58.

Figure 3:
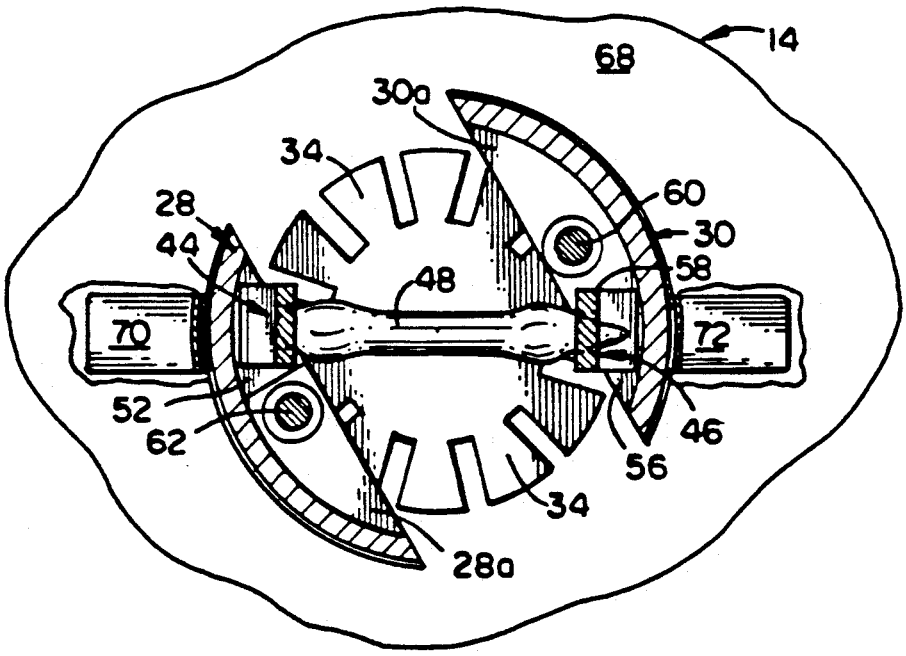
FIG. 3 is a fragmented plan view of the sprinkler.

Referring to FIGS. 2 and 3, the deflector plate 34 is preferably coupled with the arms 28 and 30 through slide pins 60 and 62, respectively. Preferably, one end of each pin 60 and 62 is fixedly coupled to the deflector plate 34, for example by passing a tapered end portion of each pin through a bore in the deflector plate and swagging the protruding end of the pin. Preferably each pin 60 and 62 is slidably mounted to separate one of the arms 28 and 30, by being passed through bores in crescent flange portions **28*a* and 30*a* of each arm 28 and 30, best seen in FIG. 3, which extend transversely across each arm 28 and 30 at a lower end of each arm most remote from the sprinkler body 16. Enlarged upper ends of each pin, one of which is visible in FIG. 2 at 60*a*, prevent the pins 60 and 62 from passing entirely through the flange portions 28*a* and 30*a*. The final position of the deflector plate 34, when suspended from the pins 60 and 62, is indicated in phantom in FIG. 2. The deflector plate 34 can be externally supported at an initial position between the final position indicated in phantom and the uppermost position indicated in solid in FIG. 2. It will be apparent that when released from such an intermediate position and permitted to drop to the final position, the deflector plate 34 will then be spaced farther and lower from the outlet 20** than it was at the initial position.

Preferably, the sprinkler 12 is provided with a ceiling cover indicated at 14 over the lower end of the sprinkler 12 including the deflector plate 34. Cover 14 preferably includes a generally conical shallow ceiling plate 68 and a pair of bracket members 70 and 72 attached to a concave inner side of the ceiling plate 68. Preferably, bracket members 70 and 72 are coupled to the plate 68 through solder joints 74 and 76, respectively, the solder melting at a temperature lower than the temperature at which the temperature-sensitive element 48 looses its physical integrity. The solder joints 74 and 76 comprise thermally sensitive coupling means joining the ceiling plate and bracket members for releasing the ceiling plate and bracket members when heated. The ceiling plate 68 is preferably a material with high thermal conductivity, such as copper, for quickly carrying heat to the solder joints 74 and 76.

Figure 1:
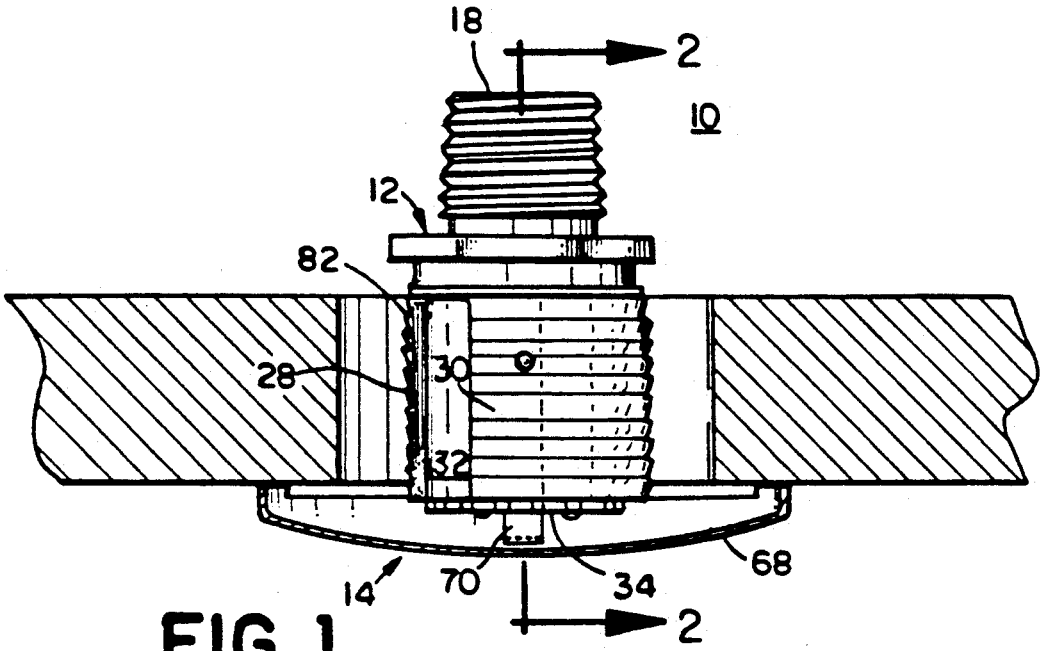
FIG. 1 is a side elevation of a preferred embodiment covered ceiling sprinkler.

Preferably, the ceiling plate 68 is coupled to the sprinkler 12 through the fork arms 28 and 30. Preferably, the bracket members 70 and 72 are made of a resiliently flexible material such as metal. Preferably each bracket member includes a tab 78 and 80, respectively, formed by cutting part of the bracket 70 and 72, respectively, and deflecting the cut part inwardly. At the same time, outer surfaces of the fork arms 28 and 30 are preferably provided with grooves or slots 82, best seen in FIG. 1. The tabs 78 and 80 and grooves 82 constitute means for coupling each of the brackets 70 and 72 with the sprinkler 12 at a plurality of different heights along the sprinkler 12, the tabs 78 and 80 being receivable in any of the grooves 82. The brackets 70 and 72 thus support the ceiling plate 68 from the sprinkler 12 while the ceiling plate 68 in turn supports the deflector plate 34 at an initial position before the sprinkler is activated.

An additional advantage of the preferred design is that it eliminates the use of a separate adjustment screw for loading the element 48. Instead, the levers 44 and 46 are biased against the interposed temperature-sensitive element 48 and against the plug 36 by the sloping surfaces 52 and 56.

After assembly of the elements in roughly their indicated positions in FIG. 2, the sprinkler body is 16 screwed into the fork 26 and onto the plug 36 up to a precalibrated torque which assures that the levers 44 and 46 exert adequate force against the plug 36 to prevent leakage at rated fluid pressure. The sloping surfaces 52 and 56 tend to force levers 44 and 46 together and down those surfaces. Both movements are prevented by the temperature sensitive element 48 which prevents the ends of the levers 44 and 46 remote from the plug 36 from coming together. The surfaces 52 and 56 bias levers 44 and 46 upwards against the plug 36. The fork 26 can be coupled to the sprinkler body 16 in other ways. For example, the frame 26 with levers 44 and 46 and element 48 can be pressed towards the body 16 and pinned to the body 16 or crimped on a flange or into a groove provided on the body 16, none of which have been depicted.

Once the components of the sprinkler are assembled, installation is conventional. The inlet end of the body 16 is screwed into a drop nipple, the bracket arms 70 and 72 of the cover 14 aligned with the outer sides of the fork arms 28 and 30 and the cover 14 pressed onto the fork arms until the ceiling plate 68 contacts the lower surface of the ceiling 6 or 6' through which the sprinkler 10 is installed. The height of the brackets 70, 72 and tabs 78, 80 and height and length of slots 82 along arms 28 and 30 should be coordinated such that the tabs 78 and 80 should be too low to engage slots 82 if the sprinkler is recessed too far into the ceiling 6 or 6' for effective operation. The tabs 78 and 80 ride over the outer side walls of the arms 28 and 30 while the cover 14 is being applied, but will engage with an underlying groove 82 when removal of the cover 14 is attempted or when the cover 14 is released.

Operation of the sprinkler 10 will be described with reference to FIG. 2. In the event of a fire, hot air and gases rising to the ceiling 6 or 6' heat the ceiling plate 68 sufficiently to melt the solder joints 74 and 76, causing the ceiling plate 68 to drop from the brackets 70 and 72. The brackets 70, 72 thereafter fall away from the fork 26. The temperature-sensitive element 48 is thereafter directly exposed to hot air and gases rising through the opening 8 (or 8') in ceiling 6 (or 6') which heat the temperature-sensitive element 48 sufficiently to fracture or melt the element 48. Levers 44 and 46 will pivot towards the vertical center line of the sprinkler 10, sliding off of the surfaces 52 and 56 into the gap 32, releasing the plug 36. The plug 36 and levers 44 and 46 are blown from the sprinkler by the ensuing release of fire-retarding fluid. If it has not already fallen when the cover 14 has broken apart, the deflector plate 34 will be driven to its final position by the plug 36 and/or levers 44, 46 and/or fluid being released through the outlet. Since there is no intervening fork, the fluid flows directly from the outlet 20 and onto the deflector 34 for substantially uniform distribution all around the deflector 34 without a noticeable fork shadow.

While preferred embodiments of the sprinkler and cover have been disclosed, those of ordinary skill will appreciate that various changes could be made. For example, it would be possible to vary the configuration of the levers and the configuration and heights of the bosses and sloping surfaces. It would further be possible to substitute means other than the bosses and the sloping surfaces for biasing the levers together and preventing their movement away from the plug. For example, an adjustable set screw can be passed transversely through an arm and into engagement with one of the levers, for example, by being received in a conical recess provided in the lever, to both bias the lever towards the other lever and prevent its movement away from the plug. While separate brackets 70 and 72 are disclosed, other means can be provided such as a circular collar with tabs. Moreover, grooves may be provided along inner surfaces of the bracket members 70 and 72 and an engageable tab provided on the fork 26, its arms 28 and 30 or at even a portion of the sprinkler body 16.

This construction permits the use of a deflector plate 34 which can be relatively inexpensively stamped as opposed to cast or machined. Preferably, the fork is fabricated as a separate unit and coupled to the body by suitable means, such as threading, as indicated. However, with the substitution of other means such as adjustment screws for the bosses 50 and/or 54, it may be possible to fabricate the arms 28 and 30 as one piece with the sprinkler body 16.

While a frangible glass ampule is preferred as the temperature-sensitive element 48, other elements may be employed including, for example, an element made of a material having a melting temperature that the desired activation temperature of the sprinkler.

It will be appreciated by those skilled in the art that other changes could be made to the above-described embodiment of the invention and suggested variations thereto, without departing from the broad, inventive concepts thereof. It should be understood, therefore, that this invention is not limited to the particular embodiment and variations disclosed, but is intended to cover any modifications which are within the scope and spirit of the invention, as defined by the appended claims.

I claim:

1. A ceiling sprinkler comprising:

a body having an internal passage terminating in an outlet for discharging a pressurized fire-retarding fluid from the body;

a plug in the outlet for sealing the passage;

a pair of opposed arms, each arm having an end depending from the body and a free end portion, the free end portions of the arms being separated by a gap aligned generally with the outlet;

a deflector supported on the arms aligned generally with the outlet and the gap;

a pair of levers, each lever extending away from the sprinkler body to an inner side of a separate one of the arms, ends of the levers proximal the body retaining the plug in the outlet;

a temperature-sensitive element positioned between the levers, for maintaining a separation of the levers before the sprinkler is activated; and means on the inner sides of the arms for biasing the levers together and for preventing movement of the levers away from the plug.

2. The sprinkler of claim 1 wherein the levers are substantially identical.

3. The sprinkler of claim 1 wherein the means for biasing comprises a surface extending along a portion of an inner side of each arm, the surface sloping inwardly towards the gap while extending away from the sprinkler along the arm wherein a portion of each lever rests upon one of the sloping surfaces.

4. The sprinkler of claim 3 wherein the arms are part of a fork coupled to the body.

5. The sprinkler of claim 3 further comprising pins coupled with the deflector and slidably mounted to the arms, the pins permitting the deflector to drop from an initial position to a final position spaced farther from the outlet than the initial position.

6. The sprinkler of claim 3 wherein each surface slopes inwardly from the arm supporting the surface at an included angle greater than 135° and less than 180° with respect to the vertical.

7. The sprinkler of claim 4 further comprising:

means coupling a deflector to the fork arms to permit the deflector to move from an initial position to a final position spaced farther from the outlet; and means coupled to the sprinkler for supporting the deflector at the initial elevation.

8. The sprinkler of claim 7 wherein the means for supporting the deflector comprises a ceiling cover coupled to the sprinkler covering the deflector.

9. The sprinkler of claim 8 wherein the means coupled to the sprinkler comprises a bracket of the cover coupled to a ceiling plate of the cover and the sprinkler further comprising means for coupling the bracket with the sprinkler at a plurality of different heights along the sprinkler.

10. The sprinkler of claim 9 wherein the means for coupling the bracket comprises a plurality of grooves along at least one of the fork arms and a tab along the bracket receivable in any of the grooves.

11. The sprinkler of claim 9 further comprising thermally sensitive coupling means joining the ceiling plate and bracket for releasing the ceiling plate and bracket when heated.

12. The sprinkler of claim 7 wherein the deflector is a stamped metal plate.

13. The sprinkler of claim 7 wherein the means coupling a deflector comprises a plurality of pins coupled with the deflector and slidably mounted with the fork arms for slidably supporting the deflector from the arms.

14. The sprinkler of claim 1 wherein the deflector is a stamped metal plate.

15. The sprinkler of claim 1 further comprising a plurality of pins coupled with the deflector and slidably mounted with the arms for slidably supporting the deflector from the arms.

16. The sprinkler of claim 1 wherein each lever is generally elongated and has a pair of opposing ends, one of the ends of each lever being proximal the body and retaining the plug in the outlet and the remaining opposing end of each lever being supported by one of the arms.

17. The sprinkler of claim 16 wherein the deflector is a separate element spaced axially apart from the plug, generally at an end of the gap opposite the sprinkler body, and wherein the pair of levers are supported by the arms positioned in the gap located generally axially between the plug and the deflector.

18. The sprinkler of claim 17 wherein the temperature-sensitive element prevents the ends of the levers axially remote from the plug from pivoting together and releasing the plug before activation of the sprinkler.

19. The sprinkler of claim 1 wherein the deflector is a separate element spaced axially apart from the plug, generally at an end of the gap opposite the sprinkler body, and wherein the pair of levers are supported by the arms positioned in the gap located generally axially between the plug and the deflector.

20. The sprinkler of claim 1 wherein the temperature-sensitive element prevents the ends of the levers axially remote from the plug from pivoting together and releasing the plug before activation of the sprinkler.

* * * * *